United States Patent [19]

Tezuka et al.

[11] Patent Number: 4,655,881

[45] Date of Patent: Apr. 7, 1987

[54] BRUSH PLATING METHOD FOR CONNECTOR TERMINALS

[75] Inventors: Junichi Tezuka; Yasuto Murata, both of Kanagawa, Japan

[73] Assignee: Electroplating Engineers of Japan, Limited, Tokyo, Japan

[21] Appl. No.: 852,675

[22] Filed: Apr. 16, 1986

[30] Foreign Application Priority Data

Apr. 26, 1985 [JP] Japan ..... 60-89016

[51] Int. Cl.[4] ..... C25D 5/02

[52] U.S. Cl. ..... 204/15

[58] Field of Search ..... 204/15

[56] References Cited

U.S. PATENT DOCUMENTS

| | | | |
|---|---|---|---|
| 4,029,555 | 6/1977 | Tezuka et al. | 204/15 |
| 4,119,499 | 10/1978 | Eidschun | 204/15 |
| 4,220,504 | 9/1980 | Hanley et al. | 204/15 |
| 4,224,117 | 9/1980 | Edwards et al. | 204/15 |
| 4,278,520 | 7/1981 | Turner | 204/207 |
| 4,280,882 | 7/1981 | Hovey | 204/15 |
| 4,427,520 | 1/1984 | Bahnsen et al. | 204/224 R |

FOREIGN PATENT DOCUMENTS

| | | | |
|---|---|---|---|
| 55-83180 | 6/1980 | Japan | 204/15 |
| 59-126784 | 7/1984 | Japan | 204/15 |

*Primary Examiner*—T. M. Tufariello

*Attorney, Agent, or Firm*—Flynn, Thiel, Boutell & Tanis

[57] ABSTRACT

Fork-like connector terminals are moved along the pass line under guidance so that the forked end part thereof won't pass astray from the predetermined passageway. A plating brush, which has been positioned in alignment with the predetermined passageway of the end part of said fork-like connector terminal, is moved into the gap between the opposing portions to be plated at the end of each terminal or passed through said gap in such a way that said brush contacts only the small-area portions to be plated and applies thereto the plating solution supplied to said brush by the liquid retaining material to thereby perform desired plating.

4 Claims, 7 Drawing Figures

BRUSH PLATING METHOD FOR CONNECTOR TERMINALS

This invention relates to a brush plating method for connector terminals, more particularly to a method for conducting noble metal plating to a desired thickness only on the small-area portions opposing to each other with a gap therebetween at the forked end part of fork-like connector terminals.

BACKGROUND OF THE INVENTION

In the prior art, as for instance illustrated in FIG. 7, various methods have been employed for plating forked end parts 4 of a train of connector terminals 3 formed in a manner of comb teeth and spaced apart a predetermined distance from each other on a continuous strip member 2 having a plurality of pilot holes 1, said connector terminals in the illustrated example being so arranged that the forked end parts thereof are oriented transversely at right angles to the pass line PL.

Especially, in case of minute plating of terminal contact portions (plated portions) 7 at the apexes of protuberant parts of small areas 6 formed opposite to each other with a minute gap 5 therebetween at the forked end part 4 of each connector terminal, there has been generally used a dip plating method in which the entirety of the forked end part 4 including the protuberant parts 6 is dipped in a plating bath not shown in the drawing and plating of the particular areas is conducted by controlling the liquid surface level, or a jet plating method in which the portion of the forked end part which needn't be plated is covered with a mask and the plating solution is jetted to the end part of each connector terminal. (See, for instance, Japanese Patent Laid-Open Nos. 126784/84, 161084/82, 83180/80, etc.).

These conventional plating methods for connector terminals, however, had the problem that a larger amount of the noble metal used for plating is consumed than is actually required for intended plating. In the case of dip plating for instance, such a problem is encountered as the peripheral surface of the forked end part 4 of each connector terminal 3 is entirely and uniformly plated. In the case of jet plating using a mask, especially when it is used for plating the terminal contact portions 7 of small areas opposing to each other with a minute gap 5 therebetween as shown in FIG. 7, it is difficult to precisely define the areas to be plated and also great difficulties are involved in perfectly masking the terminal end part of such a specific configuration. Examinations by the present inventors have shown that in case of plating the terminal contact portions 7 such as shown in FIG. 7 with gold by the methods, the entire plated portion covers 10–20 times the area which is actually required to be plated, and also gold is deposited on portions other than the portion necessary to be plated to a thickness 1.5 to 3 times that of the necessary amount. The amount of noble metal used in such plating may reach in total 15–50 times the amount actually needed for plating the desired part. Accordingly, the reduction of noble metal consumption in this type of plating has been strongly desired.

BRIEF SUMMARY OF THE INVENTION

The present invention has been made for eliminating such a problem of the conventional connector terminal plating methods, and it has for its object to provide brush plating methods for connector terminals, which methods are capable of greatly reducing the consumption of noble metal in such plating operations by performing noble metal plating only on the small areas which need to be plated to a desired thickness.

According to the present invention, the fork-like connector terminals are moved along the pass line under guidance so that the forked end part thereof won't pass astray from the predetermined passageway, and a plating brush, which has been positioned in alignment with the predetermined passageway of the end part of said fork-like connector terminal, is moved into the gap between the opposing portions to be plated at the end of each terminal or passed through said gap in such a way that said brush contacts only the small-area portions to be plated and applies thereto the plating solution supplied to said brush by the liquid retaining material to thereby perform desired plating.

Many other features, advantages and additional objects of the present invention will become manifest to those versed in the art upon making reference to the detailed description which follows and the accompanying sheet of drawings.

DESCRIPTION OF THE PREFERRED EMBODIMENTS

Figure 1:
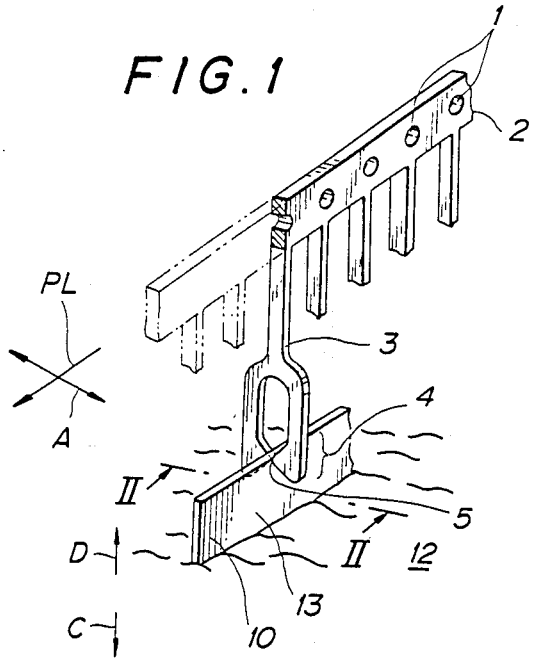
FIG. 1 is a perspective view of an example of plate-like plating brush used in the brush plating method for connector terminals according to this invention.

Hereinafter, the present invention is described in more detail with reference to FIGS. 1 to 6.

Incidentally, in the drawings, like reference numerals are used to indicate like parts throughout.

A plate-like plating brush 10 is positioned along a pass line PL of connector terminals 3. This plating brush 10 is arranged movable vertically by a drive means not shown in the drawing.

Said plating brush 10 has a thin plate-like insoluble anode 11 whose surface is coated with a liquid retaining material 13 such as non-woven fabric, which is flexible, absorbs a plating solution 12 and is wettable with it to a sufficient degree. Said brush 10 is designed to have such a configuration and a width (W) that it can get into or out of the small gap 5 between the portions to be plated of the opposing protuberant parts 6 of the connector terminals 3 in such a way that said brush contacts said parts to be plated, that is, the terminal contact portions 7.

The cycle of the upward and downward movements of said brush 10 into and out of said gap 5 is properly determined according to the mode (continuous or intermittent) and speed of the movement of the connector terminals 3.

Figure 2:
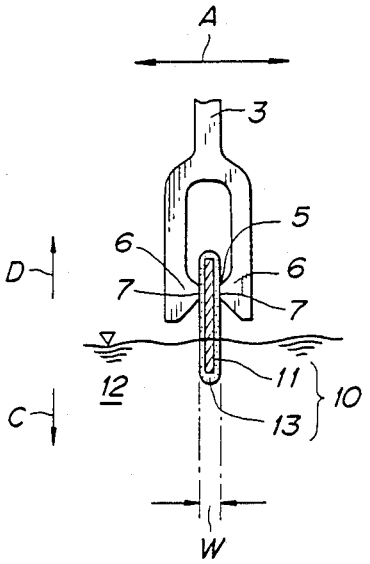
FIG. 2 is a sectional view taken along the line II—II of FIG. 1.
Figure 3:
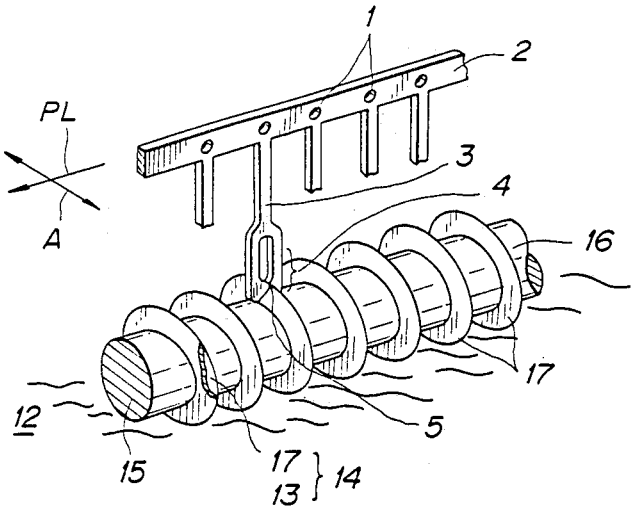
FIG. 3 is a perspective view of a rotary plating brush used in the brush plating method for connector terminals according to this invention.

Incidentally, the plating brush 10 may not necessarily be of a plate-like type which makes vertical movements as illustrated in FIGS. 1 and 2; it may be of a rotary type which continuously passes through the gap 5 as shown in FIG. 3.

This rotary type brush is used for plating of the connector terminals 3 which have their forked end parts 4 arranged parallel to the pass line PL. In this case, a columnar rotary brush 14 is moved while rotating on its own axis along the pass line PL of connector terminals 3 to effect plating of small sections.

This rotary brush 14 consists of a columnar rotator 15 and a protuberant insoluble anode 17 provided spirally around the peripheral surface 16 of said rotator 15 like a thread at a predetermined pitch, said protuberant anode 17 having its external surface coated with a liquid retaining material 13.

During movement of the connector terminals 3 along the pass line PL, the brush 10 (or 14) gets into the small gap 5 and contacts the areas to be plated of the opposing protuberant portions 6 of the connector terminal 3, so that the forked end part 4 of the connector terminal 3 is formed to make fine motions in the lateral directions (the directions indicated by A) to cause the so-called "runout". Therefore, it is necessary to regulate the movement of connector terminals 3 so as to prevent such runout.

If such runout occurs to a large extent, the brush 10 (14) may become unable to get into or pass through the small gap 5 of the connector terminal 3 and to smoothly contact the terminal contact portions 7. In order to avoid this, there is used a strip holder 20 formed with a recession 19 for guiding a continuous strip member 2 of connector terminals 3, or a pair of sprockets 22 or the like each having on its periphery protrusions 21 meshed with pilot holes 1 for regulating the position of the continuous strip member 2 on both sides thereof while rotating.

The present invention concerns a method for brush plating the terminal contact portions 7 of each connector terminal 3 by the described plating means. The way of brush plating according to the present invention is described below.

Figure 4:
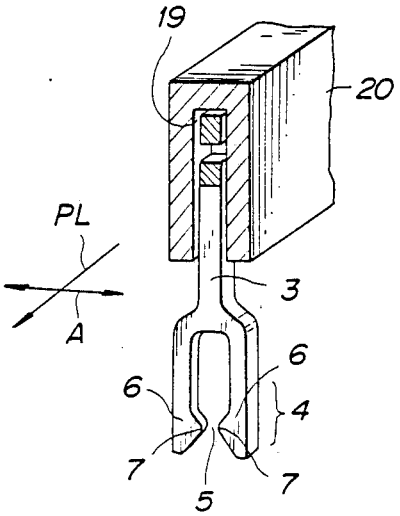
FIG. 4 is a schematic perspective view illustrating a mode of movement of connector terminals guided by a strip holder.
Figure 5:
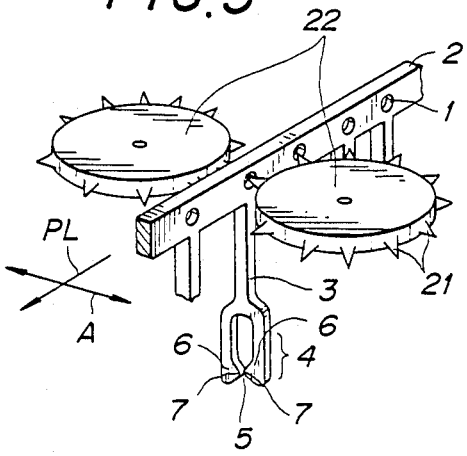
FIG. 5 is a schematic perspective view illustrating a mode of movement of connector terminals guided by a pair of sprockets.

In case of using a plate-like plating brush 10 such as shown in FIGS. 1 and 2, connector terminals 3 are moved along a pass line PL by using a guide means such as shown in FIG. 4 or FIG. 5 (a strip holder 20 or sprockets 22) so that the forked end part of said connector terminals 3 won't swerve from a predetermined passageway. The brush 10 first descends (in the direction indicated by C) into a plating solution 12 and is dipped therein substantially in its entirety so that said brush 10 absorbs and is wetted with the plating solution, and then said brush 10 ascends (in the direction indicated by D) while keeping itself in alignment with the predetermined passageway of the forked end part 4 of the connector terminal 3. In the course of this ascending movement, said brush 10 gets into a small gap 5 between terminal contact portions 7, with a liquid retaining material 13 of said brush contacting said terminal contact portions 7 of the terminal 3 which move along the pass line PL.

At this time, both connector terminals 3 and plating brush 10 are electrified. The connector terminal 3 is designed to serve as a cathode while the plating brush 10 serves as an anode, and under this condition, noble metal plating is conduced on the opposing terminal contact portions 7. As plating advances, metal ions contained in the liquid retaining material 13 are gradually reduced, making it difficult to carry on the plating smoothly, so that upon passage of a proper time after the contact, the plating brush 10 is again moved downward (in the direction of C) and dipped in the plating solution 12 so that the brush absorbs and is wetted sufficiently with the plating solution.

Said series of operations are conducted cyclically to accomplish the plating of a series of connector terminals 3 moving successively along the pass line PL.

In case of using a rotary plating brush 14 shown in FIG. 3, said rotary plating brush 14 is arranged so that the lower half thereof is dipped in the plating solution 12. As the connector terminal 3 move along the pass line PL, the rotary plating brush 14 passes through the gap 5 while turning. The liquid retaining material 13 of said brush is dipped in the plating solution 12 so that it absorbs and is wetted with the said plating solution, and then the brush (spiral portion) is passed through the small gap 5 between the terminal contact portions 7, with the liquid retaining material 13 contacting said terminal contact portions 7 which are to be plated, and at this stage, both connector terminals 3 and brush 14 are electrified, said connector terminal serving as a cathode and said brush as an anode, to perform plating continuously.

In another embodiment of this invention, beside using the same plating means as employed in the above-described embodiment, electrification is effected by applying a pulse current instead of a smooth current so that a high current density is obtained.

It is supposed that a prominent effect of pulse current on the formation of an excellent noble metal deposit is attributable to the following fact: in the case of electrification by applying a pulse current, the plating operation is suspended for a certain period of time as the electric current is cut off immediately after application of a rectangular pulse of a high current density, so that the complex of noble metal (for example, gold complex) around the cathode does not become deficient and always a necessary amount of complex for plating can be supplied without delay. That is, in case of using a pulse current, hydrogen scarcely separates out unlike the case of plating conducted by applying a smooth current, and this is supposed to result in the formation of a high-quality noble metal deposit.

Shown hereinbelow are results of plating tests in which plating was conducted on terminal contact portions 7 of a connector terminal 3 shown in FIG. 6 by the plating means using a plate-like plating brush 10.

In the following description, letters a, b, c and d designate respectively the parts of the connector terminal 3 indicated by the same letters in FIG. 6.

Test 1

Plating conditions:

Cobalt-containing gold plating solution: 16 g/l

Solution temperature: 50°-60° C.

| Current density (A/dm²) | Electrification time (sec) | Measured points | Deposit thickness (μ) |
|---|---|---|---|
| 4.7 | 15 | a | 0.21 |
| | | b | 0.16 |
| | | c | 0.23 |
| | | d | 0.21 |

Figure 6:
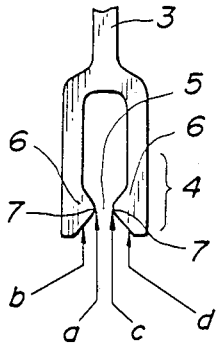
FIG. 6 is a schematic perspective view of the forked end part of a connector terminal, showing the points of measurement of deposit thickness in the tests of the brush plating method for connector terminals according to this invention.
Figure 7:
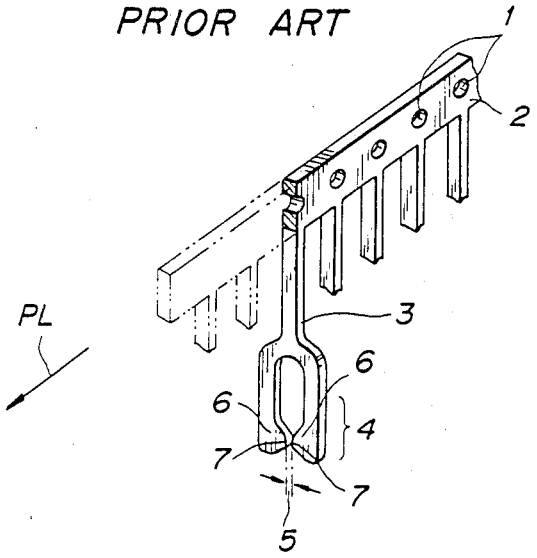
FIG. 7 PRIOR ART
FIG. 7 is a schematic perspective view showing the conventional array of fork-like connector terminals.

In this test, gold plating was conducted on the connector terminal shown in FIG. 6 according to the method of the invention by applying a smooth current continuously for the period noted above.

The thickness of the formed gold coat deposited was 0.21–0.23μ (average: 0.22μ) at the parts to be plated (terminal contact portions 7; measured points a and c) and 0.16–0.21μ (average: 0.18μ) at the parts not required to be plated (measured points b and d), which indicates that according to the plating method of this invention, the parts which need to be plated can be plated to a considerably greater thickness than the other parts (where plating is not required). The formed deposit was free of cracks and irregular colors and also generally good in luster.

Then, the similar tests were conducted in the same way as described above according to the another embodiment, the results of which are shown below.

Test 2

Plating conditions:
High-speed palladium solution
Solution temperature: 50°–60° C.

| Current density (A/dm²) | Electrification time × nr. of times of plating | Measured points | Deposit thickness (μ) |
|---|---|---|---|
| 9.4 | 3 sec. × 5 | a | 0.64 |
| | | b | 0.50 |
| | | c | 0.53 |
| | | d | 0.54 |
| 12.5 | 3 sec. × 4 | a | 0.57 |
| | | b | 0.42 |
| | | c | 0.67 |
| | | d | 0.61 |
| 15.6 | 2.5 sec. × 4 | a | 0.46 |
| | | b | 0.42 |
| | | c | 0.47 |
| | | d | 0.40 |

In Test 2, palladium plating was carried out according to the another embodiment. Pulse currents of three different current densities respectively were applied for a fixed period of time (3–2.5 seconds), and plating was repeated a specified number of times (4–5 times) in each case. The thickness of the palladium plating coat thereby formed was 0.46–0.67μ (average: 0.56μ) at the parts to be plated (terminal contact portions 7; measured points a and c) and 0.40–0.54μ (average: 0.47μ) at the parts not required to be plated (measured points b and d), which shows that according to the method of the another embodiment, the parts which need to be plated can be plated more thickly than the other parts. Also, the deposit had no crack and discoloration and had generally good luster.

Test 3

Plating conditions:
High-speed palladium plating solution: 25 g/l
Solution temperature: 50°–60° C.
Chopper (pulse waveform)

| Current density (A/dm²) | Electrification time × nr. of times of plating | Measured points | Deposit thickness (μ) |
|---|---|---|---|
| 18.8 | 2.75 sec. × 3 | a | 0.53 |
| | | b | 0.41 |
| | | c | 0.49 |
| | | d | 0.23 |
| 25.0 | 3 sec. × 2 | a | 0.49 |
| | | b | 0.31 |
| | | c | 0.37 |
| | | d | 0.19 |
| 31.3 | 2.5 sec. × 2 | a | 0.57 |
| | | b | 0.34 |
| | | c | 0.57 |
| | | d | 0.41 |
| 51.6 | 1 sec. × 3 | a | 0.41 |
| | | b | 0.43 |
| | | c | 0.59 |
| | | d | 0.50 |
| 62.5 | 1.25 sec. × 2 | a | 0.44 |
| | | b | 0.29 |
| | | c | 0.48 |
| | | d | 0.36 |
| 71.9 | 1.09 sec. × 2 | a | 0.34 |
| | | b | 0.26 |
| | | c | 0.47 |
| | | d | 0.32 |

In this test, palladium plating was conducted according to the method of the another embodiment. Pulse currents of six different current densities were applied for a fixed period of time (1–3 seconds), and plating was repeated a specified number of times (2–3 times) in each case. The thickness of the thus formed palladium plating coat was 0.34–0.59μ (average: 0.48μ) at the parts to be plated (terminal contact areas 7, measured points a and c) and 0.19–0.50μ (average: 0.34μ) not required to be plated (measured points b and d). It is seen that according to the plating method of the another embodiment, the parts that need to be plated can be plated more thickly than the other parts. The deposit had no cracks and irregular colors and had generally good luster.

Test 4

Plating conditions:
Cobalt-containing gold plating: 16 g/l
Solution temperature: 50°–60° C.
Chopper (pulse waveform)

| Current density (A/dm²) | Electrification time × nr. of times of plating | Measured points | Deposit thickness (μ) |
|---|---|---|---|
| 6.3 | 5 sec. × 6 | a | 0.68 |
| | | b | 0.57 |
| | | c | 0.67 |
| | | d | 0.63 |
| 12.5 | 5 sec. × 3 | a | 0.62 |
| | | b | 0.51 |
| | | c | 0.55 |
| | | d | 0.43 |
| 9.4 | 5 sec. × 4 | a | 0.80 |
| | | b | 0.58 |
| | | c | 0.80 |
| | | d | 0.64 |
| 12.5 | 2.5 sec. × 4 | a | 0.54 |
| | | b | 0.33 |
| | | c | 0.52 |
| | | d | 0.42 |
| 15.6 | 2.5 sec. × 3 | a | 0.84 |
| | | b | 0.51 |

-continued

| Current density (A/dm²) | Electrification time × nr. of times of plating | Measured points | Deposit thickness (μ) |
|---|---|---|---|
| | | c | 1.06 |
| | | d | 0.62 |

In Test 4, gold plating was performed according to the method of the another embodiment, in which pulse currents of five different current densities respectively were applied for a fixed period of time (2.5–5 seconds) and the plating was repeated a specified number of times (3–6 times). The thickness of the resulting gold coat deposited was 0.52–1.06μ (average: 0.71μ) at the parts to be plated (terminal contact areas 7, measured points a and c) and 0.33–0.64μ (average: 0.52μ) at the parts not to be plated (measured points b and d). These results show that according to the methods of the another embodiment, the parts to be plated can be plated more thickly than the other parts. Also, the deposit was free of cracks and irregular colors and had generally good luster.

Test 5

The plating was conducted on the connector terminal 3 shown in FIG. 6 under the same conditions as in Test 4 by using the plating means shown in FIGS. 1 and 2, whereby a pair of terminal contact portions (parts to be plated) 7 on both sides of the small gap 5 could be gold plated in a desirable way. Plating was carried out by applying a pulse current of a current density of 6.3 A/dm² for a period of 5 seconds. The plating was repeated 6 times (hence the brush was dipped in the plating solution 6 times). The result showed that gold was deposited to a thickness of 0.68μ only at the terminal contact portions 7 (parts to be plated), the other parts remaining substantially free of deposit or having a deposit of only an extremely small thickness which was in effect substantially the same as not plated at all, thus allowing the corresponding saving of gold.

The brush plating method for connector terminals according to the present invention, which has been described above in substance, has the following effects in practical application:

(a) It is possible to selectively plate only the parts which need to be plated, even if such parts are extremely small in area and spaced apart opposing to each other with a small gap therebetween.

(b) It is possible to realize a significant reduction of noble metal consumption which has been impossible with the prior art techniques although desired.

(c) In accordance with this invention, connector terminals are moved along a pass line without swerving from a predetermined position, and plating is accomplished as the plating brush contacts the parts to be plated when said brush moves into and out of the gap between said parts to be plated of the connector terminal or passes through said gap, so that there is no chance for the brush to contact the other parts of the connector terminal and hence the connector terminals remain safe from being damaged by the brush.

(d) A substantial reduction of cost can be attained by the decrease of noble metal consumption.

Besides, according to the examples of this invention, there is produced the following collateral effect:

(e) Since the liquid retaining material of the brush picks up the plating solution while stirring it as the brush makes the ascending and descending movements or a rotating motion, the plating solution applied contains metal ions uniformly and richly and therefore plating is performed always in a desirable state.

Further, in addition to the said effects (a)–(d), the following effect is provided:

(f) Since an iterative pulse current is applied to the anode side of the brush, the plating action and repose take place alternately and repeatedly, increasing the thickness of the layer electro-deposited and obtaining a high current density.

What is claimed is:

1. A method for brush plating of fork-like connector terminals formed in a manner of comb teeth and spaced apart a predetermined distance from each other on a continuous strip member, each of said connector terminals having at its forked end part small-area portions to be plated opposing to each other with a gap therebetween, wherein:

said fork-like connector terminals are moved along a pass line under guidance so that the forked end part won't swerve from a predetermined passageway; and a plating brush positioned in alignment with the predetermined passageway of said forked end part is moved into and out of or through said gap in such a way that said brush contacts only said small-area portions to be plated, opposing to each other with the gap therebetween, so as to effect plating of said portions alone, said plating brush having its insoluble anode surface coated with a liquid retaining material to which the plating solution can be always supplied according to the need, the whole body of said brush being designed to have a width corresponding to said gap.

2. A method for brush plating according to claim 1 in which an iterative pulse current are applied to an insoluble anode of said plating brush.

3. A method for brush plating according to claim 1 or claim 2 in which said plating brush is of a rotary type and comprises a columnar rotator, a protuberant insoluble anode provided spirally around a peripheral surface of the rotator and a liquid retaining material for coating an external surface of the protuberant insoluble anode.

4. A method for brush plating according to claim 1 or claim 2 in which said plating brush is of a thin plate-like insoluble anode which makes vertical upward and downward movements and whose surface is coated with a liquid retaining material.

* * * * *